US005873701A

United States Patent [19]

Shiu

[11] Patent Number: 5,873,701

[45] Date of Patent: Feb. 23, 1999

[54] DEVICE FOR CONNECTING BRACKETS AND A MOTOR OF A CEILING FAN

[76] Inventor: Sun-Quen Shiu, No. 5, Lane 189, Chien Hsing Road, Three Ho Village, Ta Ya Hsiang, Taichung Hsien, Taiwan

[21] Appl. No.: 891,730

[22] Filed: Jul. 14, 1997

[51] Int. Cl.[6] ..... F04D 29/34; F04D 29/36

[52] U.S. Cl. ..... 416/205; 416/5; 416/207; 416/210 R; 416/220 A

[58] Field of Search ..... 416/5, 205, 207, 416/208, 209, 210 R, 219 A, 220 A; 403/12, 13, 91, 97, 298, 337, 359

[56] References Cited

U.S. PATENT DOCUMENTS

| | | | |
|---|---|---|---|
| D. 82,179 | 9/1930 | Ringwald | 416/5 |
| 1,490,649 | 4/1924 | Vanderbeek | 403/359 |
| 1,634,329 | 7/1927 | Malm | 416/208 |
| 1,762,124 | 6/1930 | Moody | 416/207 |
| 4,225,191 | 9/1980 | Knoski | 403/12 |
| 4,850,799 | 7/1989 | Bucher, Sr. et al. | 416/5 |
| 4,936,751 | 6/1990 | Marshall | 416/205 |
| 5,039,118 | 8/1991 | Huang | 403/97 |
| 5,074,448 | 12/1991 | Wu | 403/97 |
| 5,354,177 | 10/1994 | Chang | 416/219 A |
| 5,458,463 | 10/1995 | Chiang | 416/5 |

FOREIGN PATENT DOCUMENTS

| | | | |
|---|---|---|---|
| 944761 | 4/1949 | France | 416/207 |
| 243454 | 11/1925 | United Kingdom | 416/220 A |

*Primary Examiner*—Christopher Verdier
*Attorney, Agent, or Firm*—Rosenberg, Klein & Bilker

[57] ABSTRACT

A device for connecting brackets and a motor of a ceiling fan includes a ring element fixedly connected to an underside of the motor and having a plurality of protrusions extending from an underside of the ring element. Each of the protrusions has an inclined surface defined in a free end thereof and each of the inclined surfaces has a plurality of first threaded holes defined therein. At least one bracket has a first end with an enlarged plate to connect to a blade and a second end having an engaging element which has at least two first holes defined therethrough so as to be fixedly connected to one of the inclined surface by extending bolts through the first holes and engaging with the first threaded holes of the protrusion.

7 Claims, 9 Drawing Sheets

DEVICE FOR CONNECTING BRACKETS AND A MOTOR OF A CEILING FAN

BACKGROUND OF THE INVENTION

1. Field of the Invention

The present invention relates to a device for connecting brackets and a motor of a ceiling fan and, more particularly, to the device which allows the brackets to be adjustably connected to the motor of the ceiling fan.

2. Brief Description of the Prior Art

FIG. 1 shows a bracket 10 to which a blade 14 is connected and a motor 12 to which the bracket 10 is connected. Conventionally, the bracket 10 has a first end connected to the blade 14 and a second end having an engaging element 11 formed thereto so as to be connected to the motor 12 such that the motor 12 carries the bracket 10 to rotate about an axis of a rod 15 which extends from a center of the motor 12. The first end of the bracket 10 has an enlarged plate 16 formed inclinedly thereto corresponding to a plane where the bracket 10 is located so that the blade 14 is disposed at a certain angle corresponding to the plane. The engaging element 11 has two holes 111 defined therethrough so that bolts 13 extend through the holes 111 and are engaged with threaded holes (not show) defined in a bottom of the motor 12. The bracket 10 has to be manufactured so that it complies with the angles of the enlarged plate of different countries and each angle requires a mold such that the manufacturing cost is high.

The present invention intends to provide an improved device for connecting brackets and a motor for a ceiling fan so as to mitigate and/or obviate the above-mentioned problem.

SUMMARY OF THE INVENTION

In accordance with one aspect of the present invention, there is provided a device for connecting brackets and a motor of a ceiling fan, and the device comprising a ring element fixedly connected to an underside of the motor and having a plurality of protrusions extending from an underside thereof. Each of the protrusions has an inclined surface defined in a free end thereof and each of the inclined surfaces has a plurality of first threaded holes defined therein. At least one bracket has a first end with an enlarged plate so as to connect to a blade and a second end having an engaging element which has at least two first holes defined therethrough so that the engaging element is fixedly connected to one of the protrusions by extending bolts through the first holes and engaging with the first threaded holes of the protrusion.

It is an object of the present invention to provide a device for a ceiling fan and which can adjust the angle of the blade in accordance with requirements in different countries.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
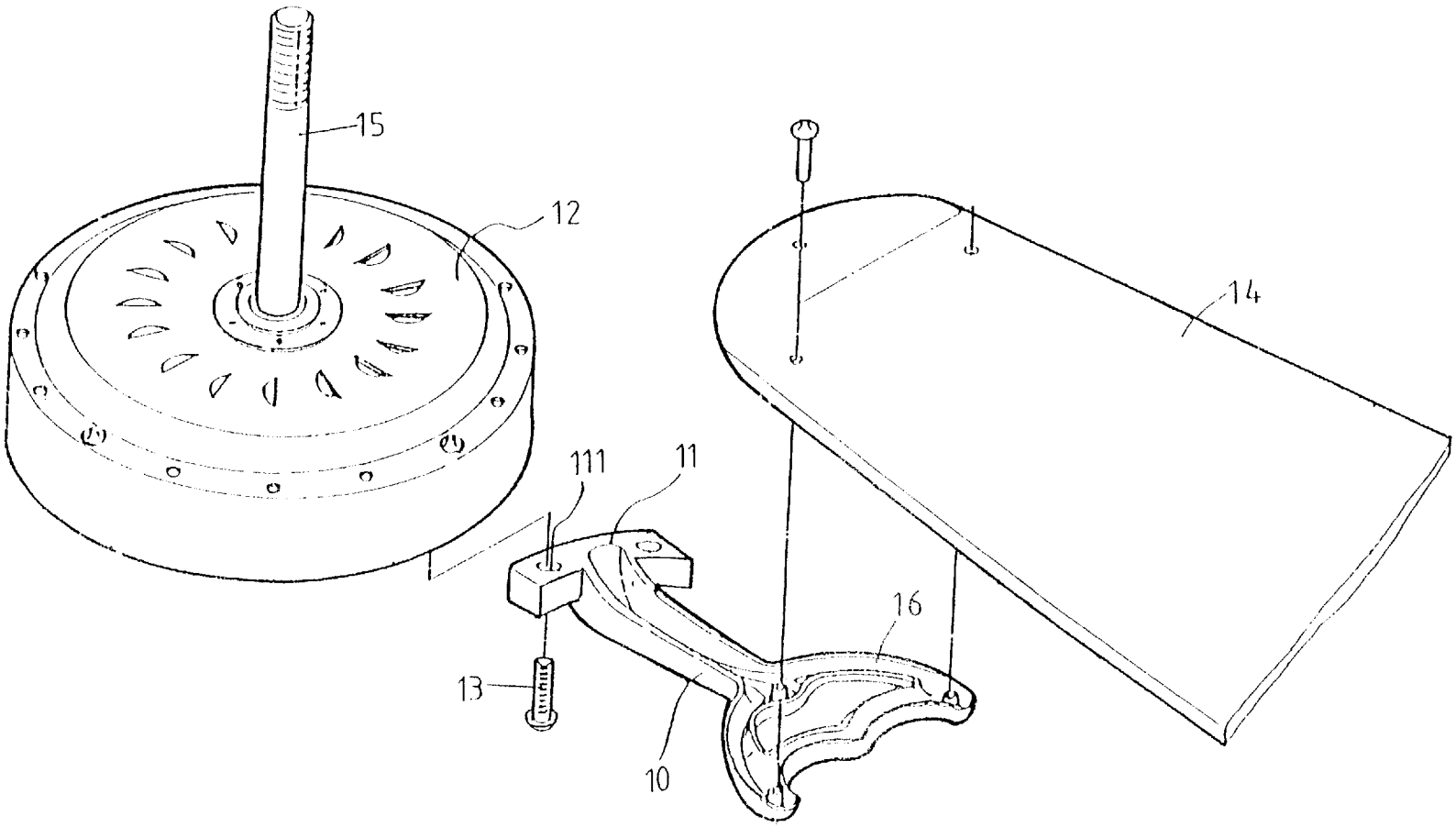
FIG. 1 is an exploded view of a conventional bracket, blade and motor.
Figure 2:
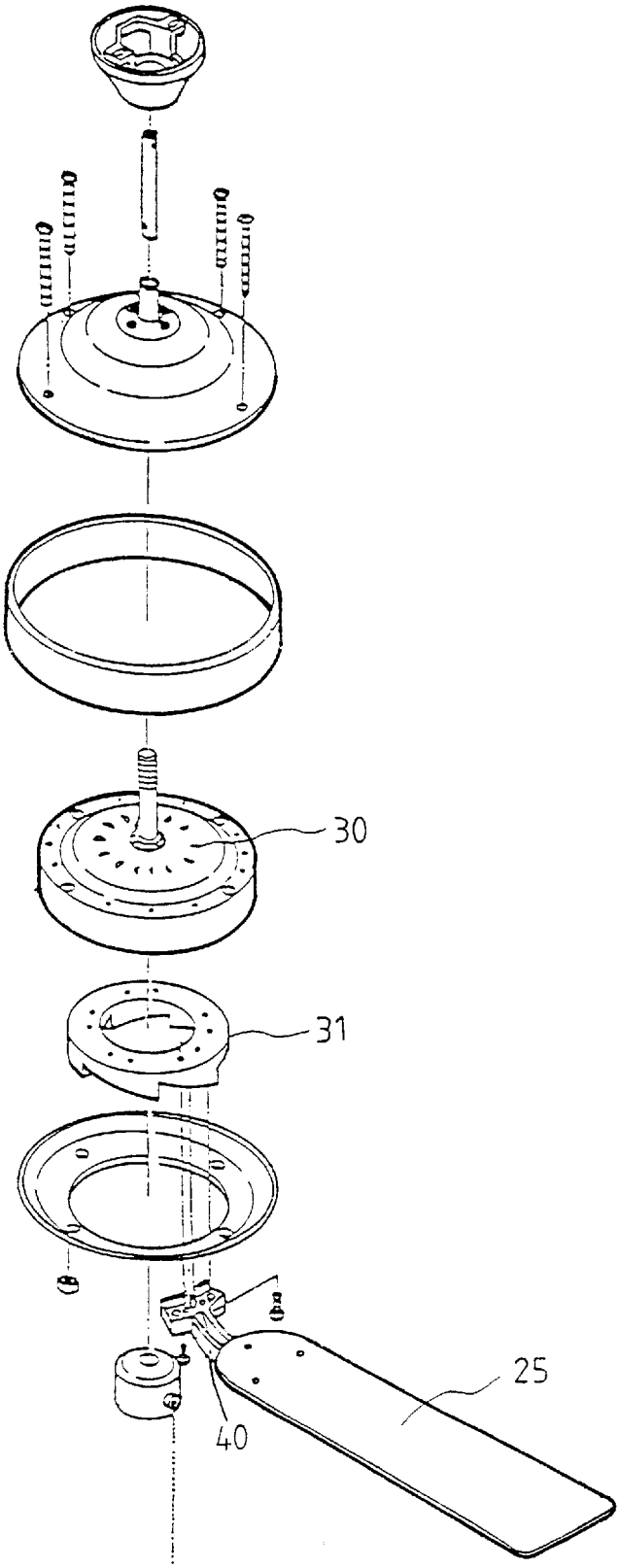
FIG. 2 is an exploded view of a device for connecting brackets and a motor of a ceiling fan in accordance with the present invention.
Figure 3:
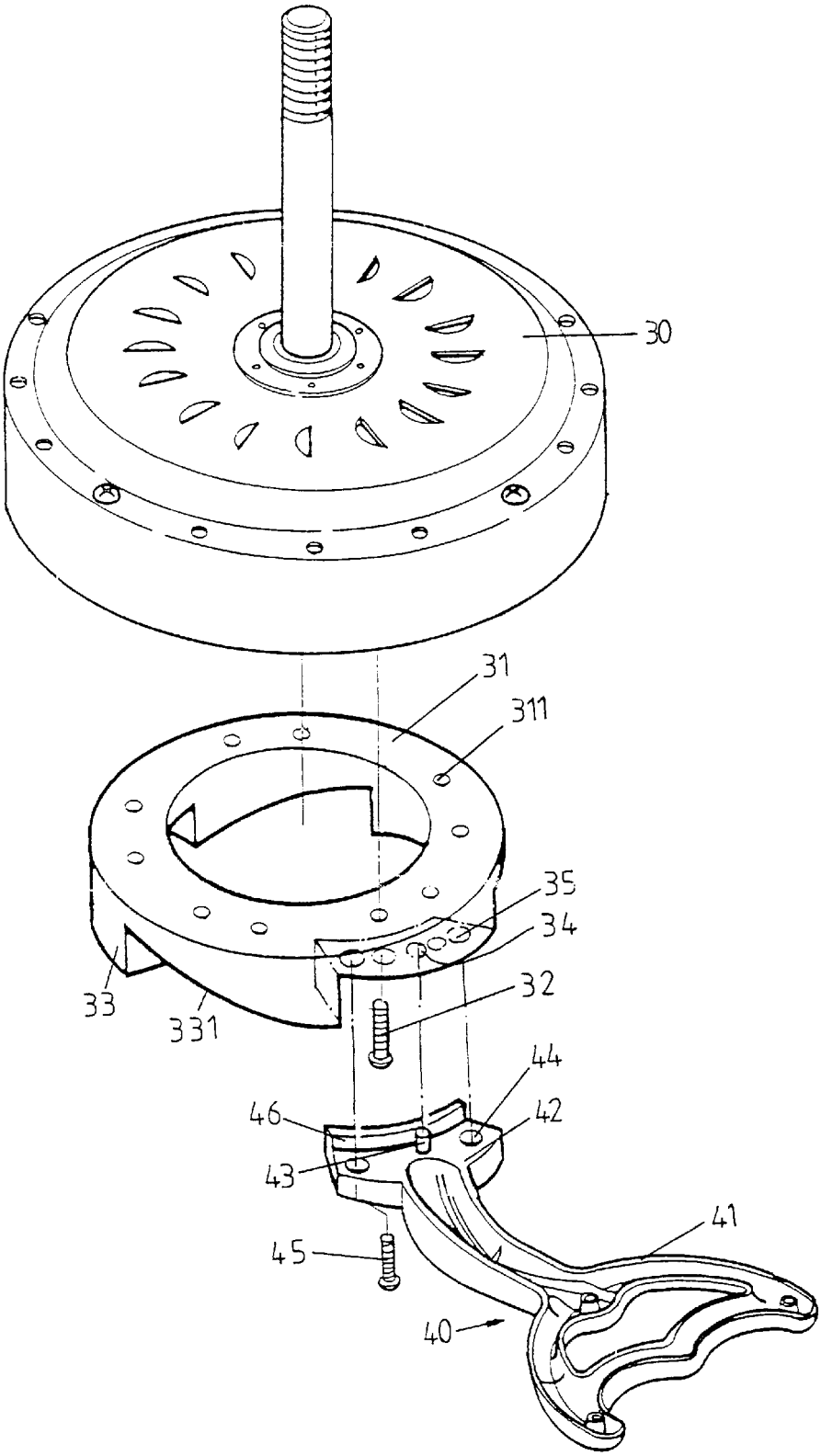
FIG. 3 is an exploded view of a first embodiment of the device in accordance with the present invention.
Figure 5:
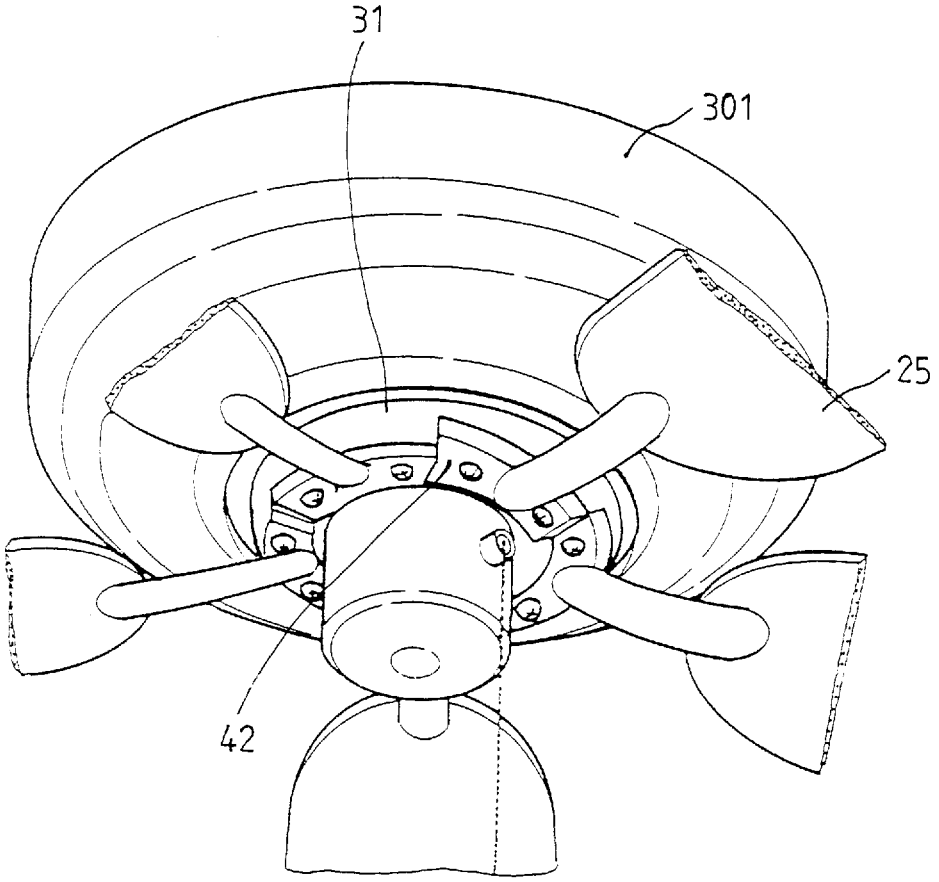
FIG. 5 is a perspective view of the ceiling fan having the device in accordance with the present invention.

Referring to the drawings and initially to FIGS. 2, 3 and 5, a device for connecting brackets 40 and a motor 30 of a ceiling fan in accordance with the present invention generally includes a ring element 31 fixedly connected to an underside of the motor 30 and having a plurality of protrusions 33 extending from an underside thereof. A plurality of connecting holes 311 are defined in a top of the ring element 31 so as to be connected to the underside of the motor 30. Each of the protrusions 33 has an inclined surface 331 defined in the free end thereof and each of the inclined surfaces 331 has a plurality of first threaded holes 35 and a second hole 34 respectively defined therein.

At least one bracket 40 has a first end with an enlarged plate 41 formed thereto so as to connect to a blade 25, and a second end having an engaging element 42 which has at least two first holes 44 defined therethrough so that the engaging element 42 is fixedly connected to the inclined surface 331 of one of the protrusions 33 by extending bolts 45 through the first holes 44 and engaging with the first threaded holes 35 of the protrusion 30. The engaging element 42 has a stud 43 extending therefrom so as to insert into the second hole 34, and has a lip 46 extending from a distal end thereof so as to engage with an inner periphery of each of the protrusion 33 when connecting to the protrusion 33.

Therefore, the bracket 40 does not need to be manufactured at a certain angle as that described in the prior art and thus reducing cost of different molds. The inclined surfaces 331 of the ring element 31 determine the angle required so that manufacturers only replace the proper ring element 31 in different countries.

Figure 4:
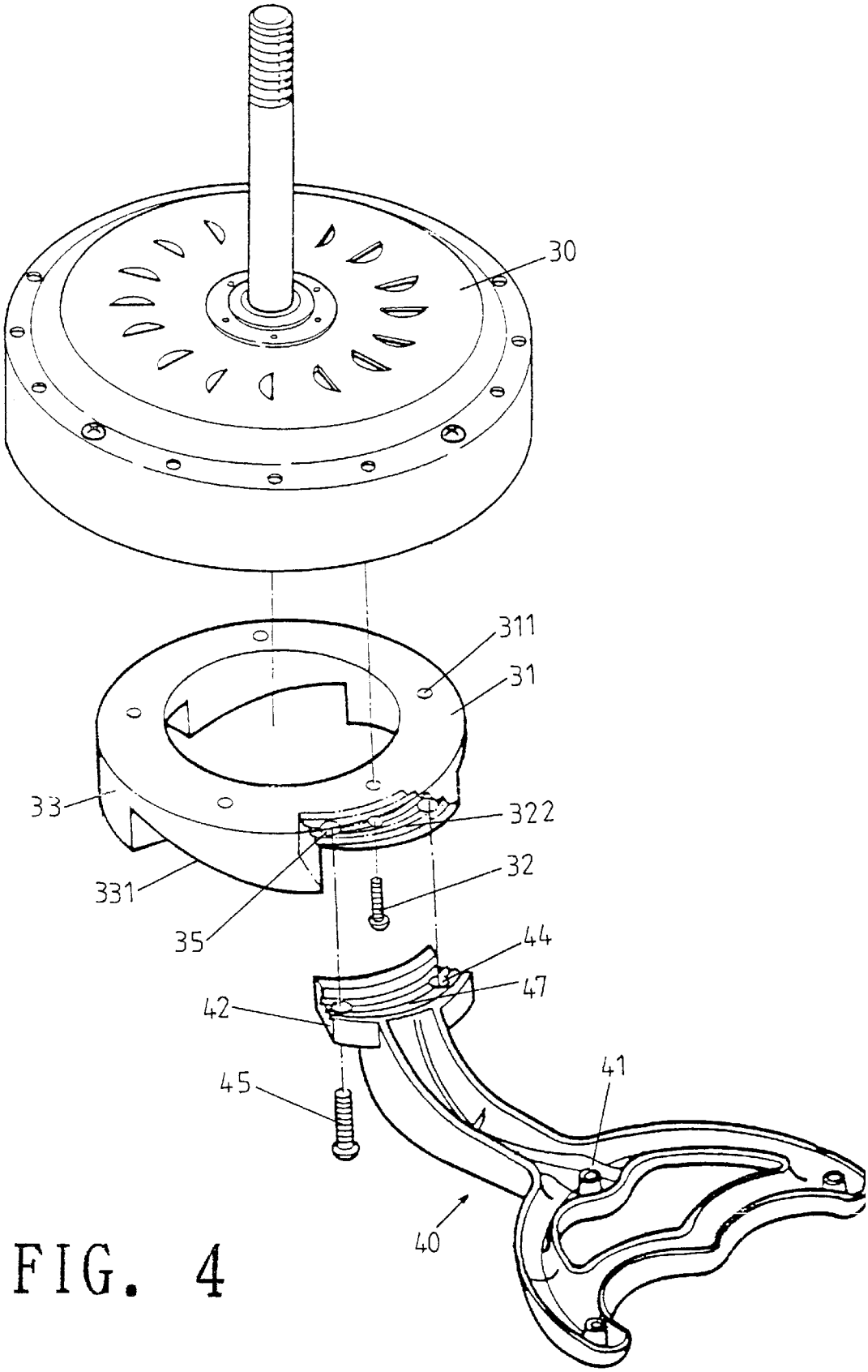
FIG. 4 is an exploded view of a second embodiment of the device in accordance with the present invention.

Referring to FIG. 4, the device has a second embodiment wherein the engaging element 42 has a plurality of first ridges 47 extending therefrom and the inclined surface 331 of each of the protrusions 33 has a plurality of second ridges 332 extending therefrom so as to engage with the first ridges 47 when the engaging element 42 contacts the inclined surface 331 corresponding thereof.

Figure 6:
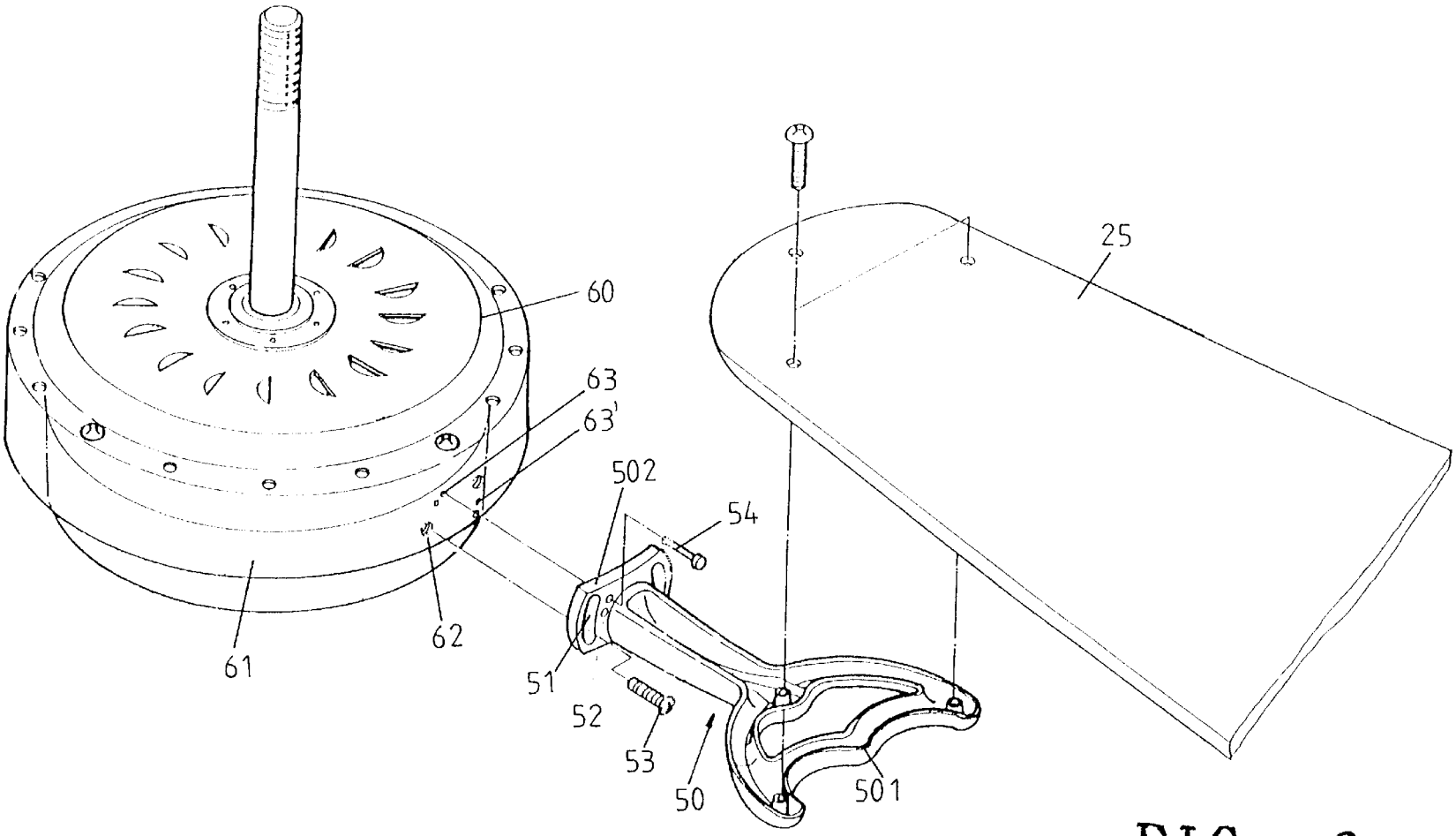
FIG. 6 is an exploded view of a third embodiment of the device in accordance with the present invention.
Figure 8:
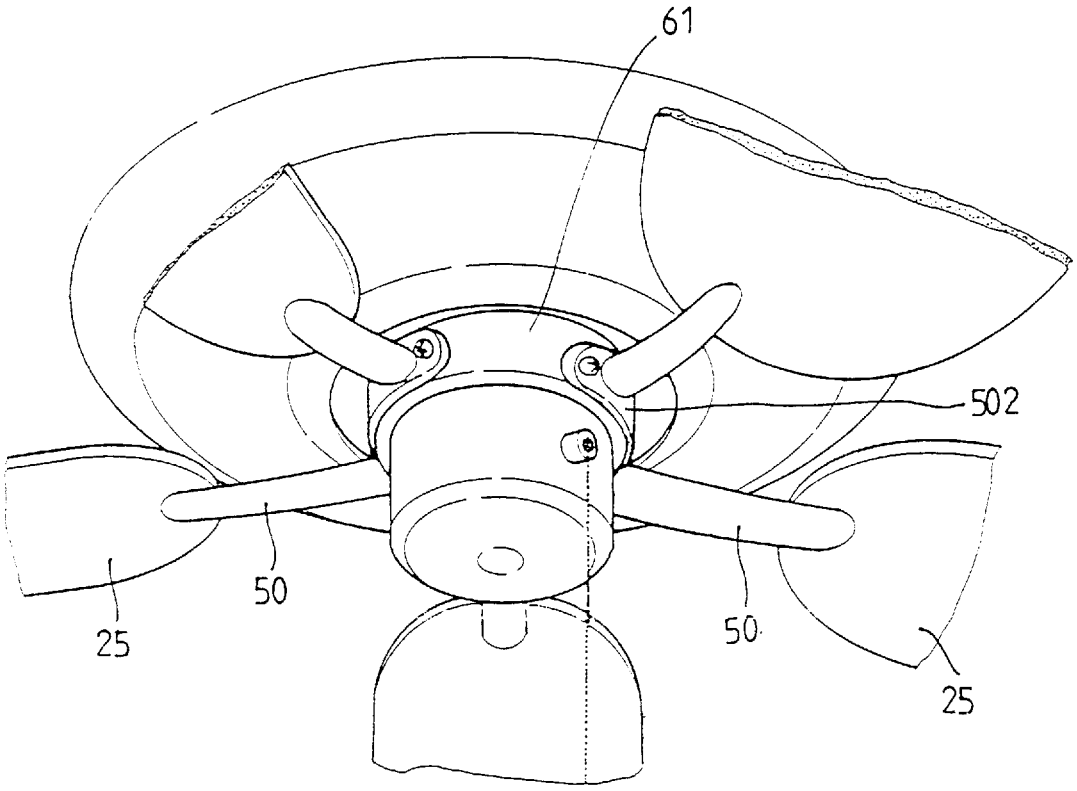
FIG. 8 is a perspective view of the ceiling fan having the fourth embodiment of the device in accordance with the present invention.

FIGS. 6 and 8 show a third embodiment of the device of the invention wherein a ring portion 61 is rotatably disposed to a peripheral wall of the motor 60 which drive the ring portion 61 to rotate and two second threaded holes 62 defined therein. At least two upper threaded holes 63 are defined in the ring portion 61 and located above the second threaded holes 62, at least two lower threaded holes 63' defined in the ring portion 61 and located below the second threaded holes 62. At least one bracket 50 has a first end with an enlarged plate 501 formed thereto so as to connect to a blade 25, and a second end having a flange 502 extending laterally therefrom. The flange 502 has two curved slots 51 defined therethrough which are located corresponding to the second threaded holes 62 and two third holes 52 are defined therethrough which are respectively located corresponding to the upper threaded holes 63 and the lower threaded holes 63'. Two first bolts 53 respectively extend through the two curved slots 51 and are engaged with the second threaded holes 62, and two second bolts 54 respectively extending through the two third holes 52 and engaged with one of the upper threaded holes 63 and one of the lower threaded holes 63'. Therefore, when adjusting the bracket 50, the flange 502 together with the bracket 50 are rotated within a limit angle via the curved slots 51 and then fixedly position the bracket 50 by the first and second bolts 53, 54. It is to be noted that the angle differences between countries are limited so that the upper threaded holes 63 and the lower threaded holes 63' could be only two or three in the ring portion 61.

Figure 7:
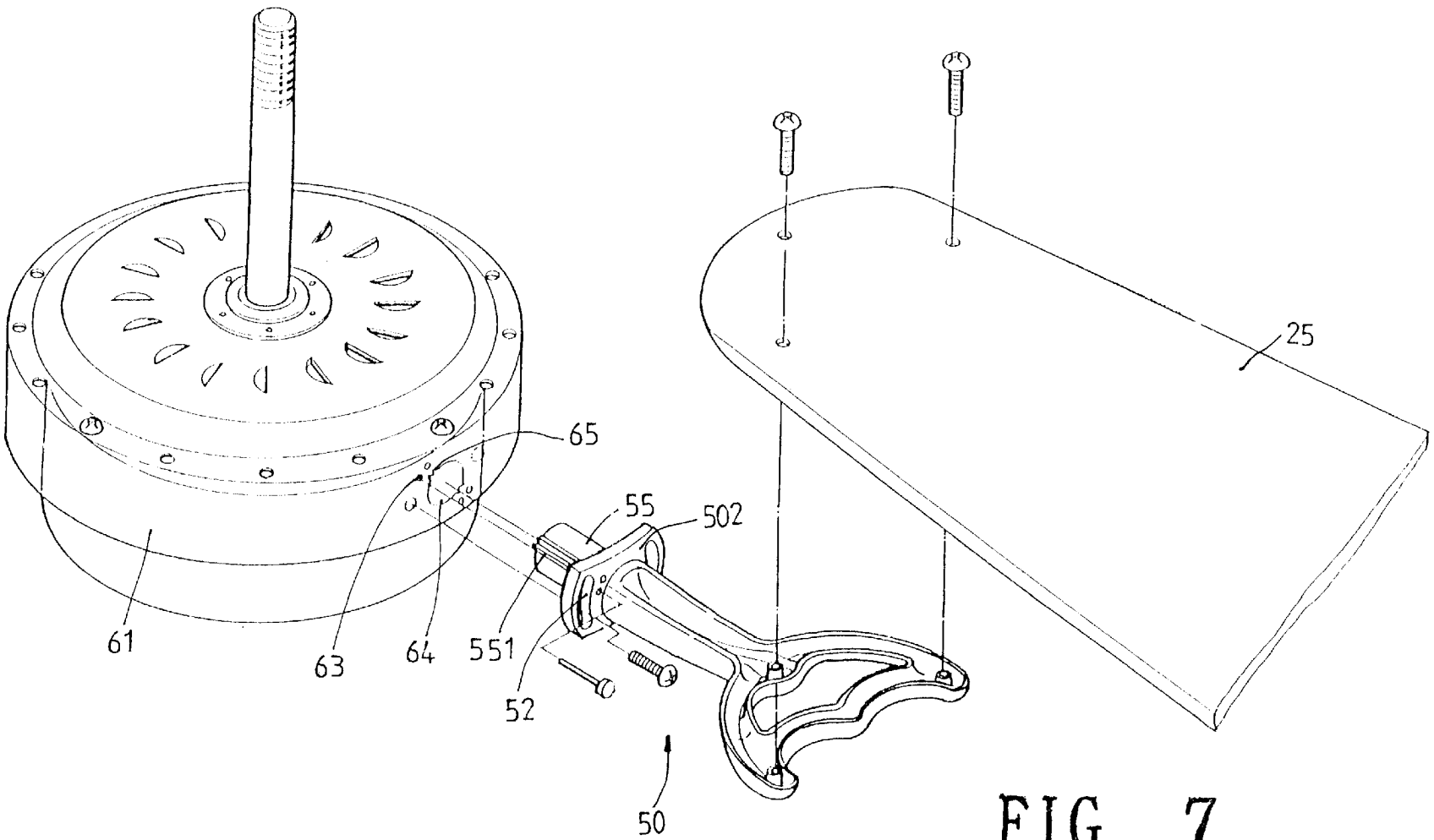
FIG. 7 is an exploded view of a fourth embodiment of the device in accordance with the present invention.

FIG. 7 shows a fourth embodiment of the device wherein a plurality of position holes 64 (only one is shown) are defined in the ring portion 61 wherein a plurality of first notches 65 are defined in an inner periphery defining each of the position holes 64. A shaft 55 extends from the second end of the bracket 50 shown in FIG. 6 and is located at a position corresponding to the position hole 64. The shaft 55 has a plurality of second notches 551 defined in an outer periphery thereof so as to be engaged with the first notches 65 when inserted into the position hole 64 corresponding thereto.

Figure 9:
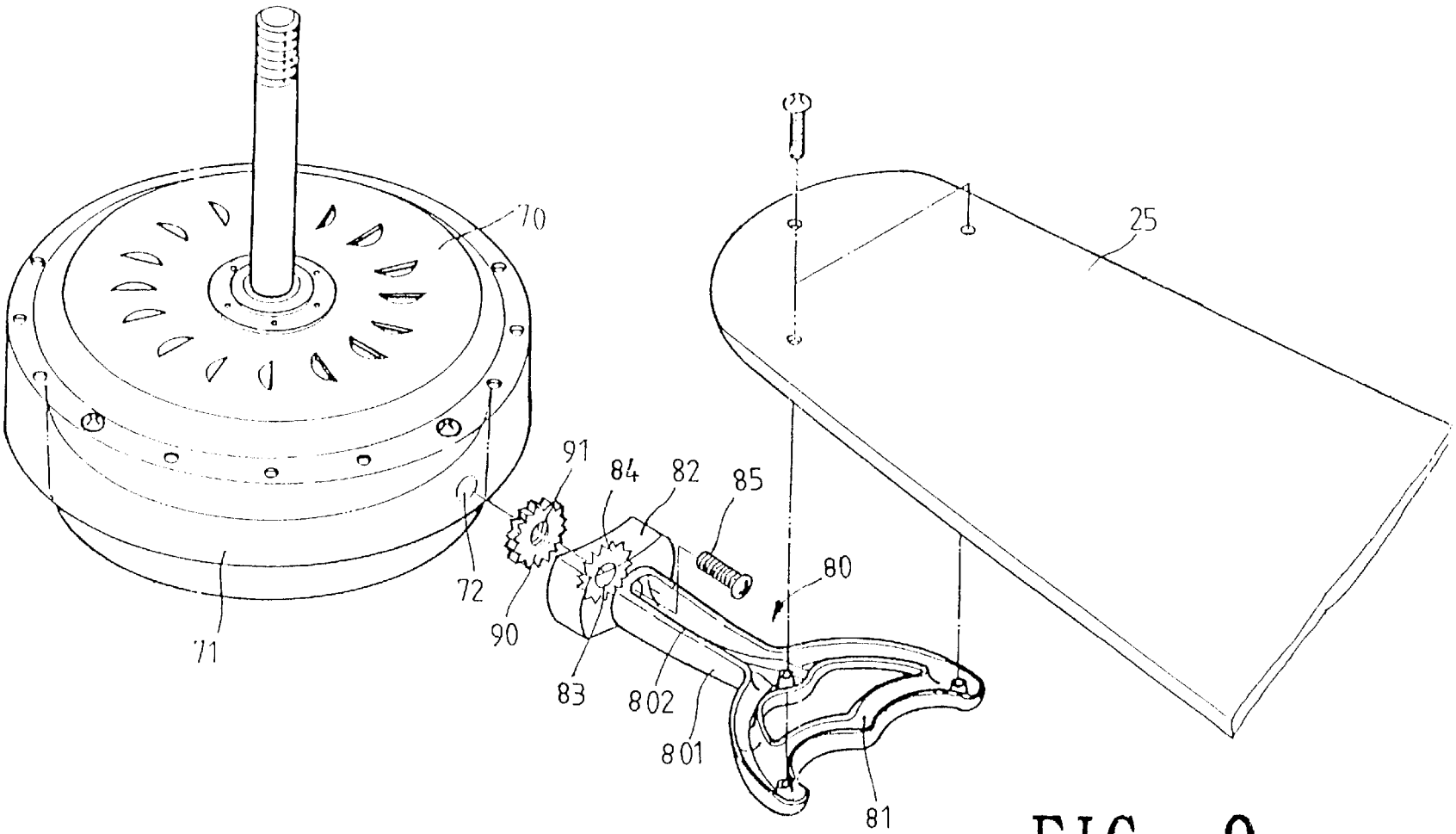
FIG. 9 is an exploded view of a fifth embodiment of the device in accordance with the present invention.

FIG. 9 shows a fifth embodiment of the device for connecting brackets and a motor, wherein the device comprises a ring portion 71 rotatably disposed to a peripheral wall of the motor 70 and a fourth hole 72 defined in the ring portion 71. At least one bracket 80 has a first end with an enlarged plate 81 formed thereto so as to connect to a blade 25, and a second end has a block 82 formed thereto which has a passage 83 defined therethrough. A hollow shank 801 is formed between the enlarged plate 81 and the block 82 and has an elongated slot 802 defined in an outer periphery thereof. The elongated slot 802 communicates with the passage 83 and a recess 84 is defined in a free end of the block 82 and communicates with the passage 83, wherein the recess 84 is defined by a star-shaped periphery.

A gear member 90 has a threaded hole 91 defined centrally therethrough and is received in the recess 84 so that the gear member 90 is engaged with the star-shaped periphery defining the recess 84. A bolt 85 extends through the passage 83 and is threadedly engaged with the threaded hole 91 so that the bracket 80 is fixedly connected to the ring portion 71. Thus, the bracket 80 can be adjusted by an proper engagement between the gear member 91 and the star-shaped periphery of the recess 84.

Although the invention has been explained in relation to its preferred embodiment, it is to be understood that many other possible modifications and variations can be made without departing from the spirit and scope of the invention as hereinafter claimed.

What is claimed is:

1. A device for connecting brackets and a motor, comprising:

a ring element fixedly connected to an underside of said motor and having a plurality of protrusions extending from an underside of said ring element, each of said protrusions having an inclined surface defined in a free end thereof and each of said inclined surfaces having a plurality of first threaded holes defined therein, and at least one bracket having a first end with an enlarged plate formed thereto so as to connect to a blade, and a second end having an engaging element which has at least two first holes defined therethrough so that said engaging element is fixedly connected to one of said protrusions by extending bolts through said first holes and engaging with said first threaded holes of said one protrusion.

2. The device as claimed in claim 1 wherein each of said protrusions has a second hole defined in each of said inclined surfaces and each of said engaging elements has a stud extending therefrom so as to insert into each of said respective second holes.

3. The device as claimed in claim 1 wherein each of said engaging elements has a lip extending from a distal end thereof so as to engage with an inner periphery of each of said respective protrusions.

4. The device as claimed in claim 1 wherein each of said engaging elements has a plurality of first ridges extending therefrom and said inclined surface of each of said protrusions has a plurality of second ridges extending therefrom so as to engage with each of said respective first ridges.

5. A device for connecting brackets and a motor, comprising:

a ring portion rotatably disposed to a peripheral wall of said motor and two first threaded holes defined in said rind portion, at least two upper threaded holes defined in said ring portion and located above said first threaded holes, at least two lower threaded holes defined in said ring portion and located below said first threaded holes, and at least one bracket having a first end with an enlarged plate formed thereto so as to connect to a blade, and a second end having a flange extending laterally therefrom, said flange having two curved slots defined therethrough which are located corresponding to said first threaded holes and two first holes defined therethrough which are respectively located corresponding to said upper threaded holes and said lower threaded holes, two first bolts respectively extending through said two curved slots and engaged with said first threaded holes, and two second bolts respectively extending through said two first holes and engaged with one of said upper threaded holes and one of said lower threaded holes.

6. The device as claimed in claim 5 wherein a plurality of position holes are defined in said ring portion wherein each of said position holes has a plurality of first notches defined in the inner periphery thereof, a shaft extends from said second end of said bracket and is located at a position corresponding to said position hole corresponding thereto, said shaft having a plurality of second notches defined in an outer periphery thereof so as to be engaged with said first notches.

7. A device for connecting brackets and a motor, comprising:

a ring portion rotatably disposed to a peripheral wall of said motor and a hole defined in said ring portion;

at least one bracket having a first end with an enlarged plate formed thereto so as to connect to a blade, and a second end having a block formed thereto which has a passage defined therethrough, a hollow shank formed between said enlarged plate and said block and having an elongated slot defined in an outer periphery of said hollow shank, said elongated slot communicating with said passage, a recess defined in a free end of said block and communicating with said passage wherein said recess is defined by a star-shaped periphery, and a gear member having a threaded hole defined centrally therethrough and being received in said recess, a bolt extending through said passage and threadedly engaged with said threaded hole so that said bracket is fixedly connected to said ring portion.

* * * * *